United States Patent [19]

Theurer

[11] 4,301,738

[45] Nov. 24, 1981

[54] APPARATUS FOR THE REPLACEMENT OF RAILS OF A TRACK

[75] Inventor: Josef Theurer, Vienna, Austria

[73] Assignee: Franz Plasser Bahnbaumaschinen-Industriegesellschaft m.b.H., Vienna, Austria

[21] Appl. No.: 87,062

[22] Filed: Oct. 22, 1979

[30] Foreign Application Priority Data

Dec. 12, 1978 [AT] Austria ..... 8856/78

[51] Int. Cl.[3] ..... E01B 29/20; E01B 29/17

[52] U.S. Cl. ..... 104/2; 33/1 Q; 33/144; 104/8

[58] Field of Search ..... 104/1R, 2, 7 R, 7 B, 104/8, 16, 17 R; 33/1 Q, 144, 287, 338

[56] References Cited

U.S. PATENT DOCUMENTS

| | | | |
|---|---|---|---|
| 1,941,930 | 1/1934 | Collet et al. | 104/2 X |
| 2,730,962 | 1/1956 | Wright et al. | 104/2 |
| 3,286,648 | 11/1966 | Brosnan | 104/2 |
| 3,685,456 | 8/1972 | Plasser et al. | 104/2 |
| 3,795,056 | 3/1974 | Plasser et al. | 33/287 |
| 3,807,310 | 4/1974 | Plasser at al. | 104/2 |
| 4,165,693 | 8/1979 | Theurer | 104/7 B |
| 4,165,694 | 8/1979 | Theurer | 104/7 B |

*Primary Examiner*—Randolph A. Reese
*Attorney, Agent, or Firm*—Kurt Kelman

[57] ABSTRACT

An apparatus for the continuous replacement of track rails comprises a forward and a trailing track renewal vehicle, which may have a common frame. The rails are unfastened and removed from a first track section on which an undercarriage supports the forward vehicle for continuous mobility and the replaced rails are laid in a second track section on which an undercarriage supports the trailing vehicle. A monitoring device is associated with the trailing track renewal vehicle to sense markings on the ties as the trailing vehicle moves along the second track section and to be guided by the markings, the markings indicating the position of the first track section and the monitoring device being arranged to position the rails of the second track section in alignment with the first track section.

17 Claims, 3 Drawing Figures

APPARATUS FOR THE REPLACEMENT OF RAILS OF A TRACK

Figures 1, 2, 3:
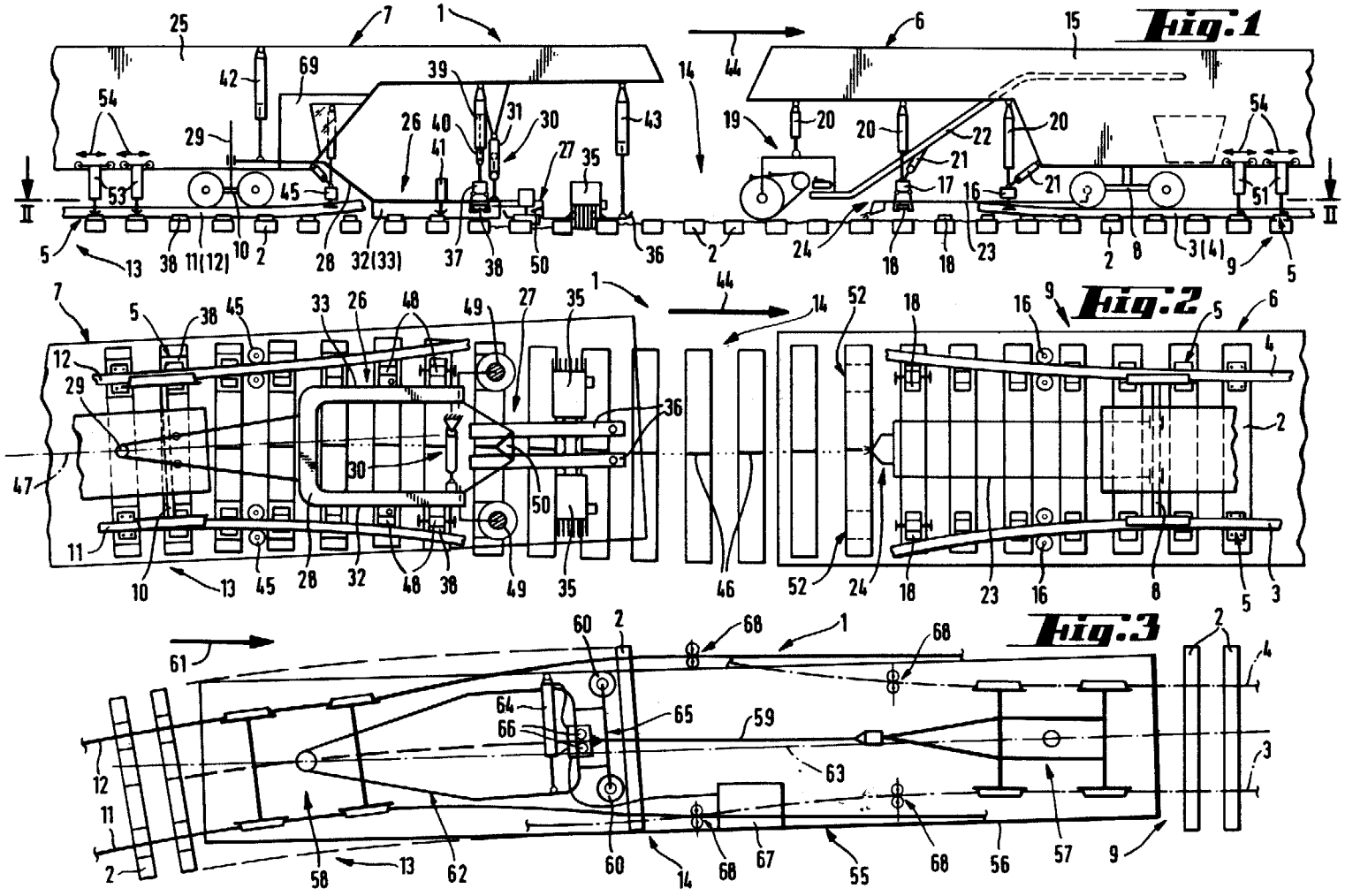

The present invention relates to improvements in an apparatus for the continuous replacement of the rails of a track consisting of two rails fastened to ties.

U.S. Pat. No. 3,795,056, dated Mar. 5, 1974, discloses a mobile track laying machine arranged to move in a working direction from a newly laid corrected to a newly laid uncorrected track section. The machine is capable of replacing the track rails and, if desired, the ties. It comprises a forward train of work cars moving on the old track and carrying tools for unfastening the rails from the ties and for removing the rails, and a trailing train of work cars moving on the newly laid track and carrying tools for laying the rails on the ties and fastening the rails to the ties. These tracks renewal trains have been used successfully for the assembly line renewal of railroad track while the train moves continuously along the track to be rehabilitated. However, under certain conditions, for example when only the track rails are to be replaced, such machines may be too expensive for economic operation. The end points of the reference systems used in the patented machine are determined by the position of the uncorrected track section. It serves for correcting the position of the track rails immediately after they have been laid.

U.S. Pat. No. 2,730,962, dated Jan. 17, 1956, discloses an apparatus for laying railway rails on tie plates positioned at the desired gauge. It uses a rolling gauge which has two double-flanged wheels supported on one rail and the ties plates for the second rail are positioned by an elongated frame supported by the wheels on the one rail. The frame is spaced from the double-flanged wheels at the distance of the desired gauge and thus aligns the tie plates for the second rail accordingly. Thus, the apparatus can be used only for laying one rail, which makes it uneconomical, in addition to being inaccurate and useful only under certain working conditions.

U.S. Pat. No. 3,286,648, dated Nov. 22, 1966, discloses a rail renewal system for the simultaneous replacement o the two rails of a track and the fastening elements securing them to the ties. The system is capable of removing the rail fastening elements, lifting the rails from the two areas of the ties whereon they are supported, preparing these tie areas for receiving new fastening elements, and then laying thereon and securing thereto the removed or new rails. The system comprises a multiplicity of individual work cars each of which operates and moves independently. The ties are not replaced. Such a system has been called a ‹rail gang" and involves considerable difficulties due to the many independently operating cars, making it frequently impossible to maintain the required tolerances and accuracy in laying railroad tracks. In addition, to enable the work cars to move along the ties remaining on the ballast bed, the removed rails and the rails to be laid must be positioned laterally spaced from the standard gauge with auxiliary fastening elements. All of this requires considerable preparatory work before the track renewal operation begins and extra work during the operation, all of which makes the track renewal difficult and cumbersome. Even placing markers on the ties before the system is put into operation does not help much because centering of the many separate work cars requires a great deal of time, not to speak of the unavoidable inaccuracies encountered in the numerous centering operations.

It is the primary object of this invention to provide an apparatus for the continuous replacement of the rails of a track, which simplifies the laying of rails on ties which remain substantially in position on the ballast bed during the rail replacement so that a track having a relatively accurate position and ready for the passage of trains is produced immediately after the track rails have been replaced.

The above and other objects are accomplished according to the invention with an apparatus comprising a forward track renewal vehicle means for removing the rails adjacent a first track section, the forward vehicle means including an undercarriage supporting the forward vehicle means on the rails to be removed for mobility along the track section in an operating direction, and tools for unfastening the rails from the ties and for removing the rails, and a trailing track renewal vehicle means for replacing the rails adjacent a second track section, the trailing vehicle means including an undercarriage supporting the trailing vehicle means on the replaced rails for mobility along the second track section in the operating direction, and tools for laying the rails on the ties. A monitoring device is associated with the trailing track renewal vehicle means and is arranged to sense markings on the ties as the trailing vehicle means moves along the second track section and to be guided by the markings, the markings indicating the position of the first track section and the monitoring device being arranged to position the rails of the second track section in alignment with the first track section.

Fastening elements fasten the rails to the ties in two areas of each tie supporting the rails, the tools on the forward vehicle means comprise means for removing the fastening elements and for raising and spreading the rails, and the tools on the trailing vehicle means comprise means for surfacing the two rail supporting areas of each tie, for laying the rails and for securing the fastening elements to fasten the laid rails to the ties at the surfaced rail supporting areas.

Such an apparatus simply produces a new track which is in relatively good condition to permit trains to pass thereover immediately after replacement of the track rails, the new track having substantially the same position as the old track. This is accomplished without the use of a relatively expensive and cumbersome reference system by simply "monitoring" the track renewal operation and the positioning of the rails being replaced in response to markings which indicate the position of the original track. This monitoring of the trailing track renewal vehicle means and its rail replacement work as the apparatus continuously moves along the track assures the accuracy of the track renewal operation and increases its speed. The absence of a reference system considerably simplifies the total structure and all the track renewal tools can be readily guided by the monitoring device. Damage to track components is avoided and manual operations are reduced to a minimum. The apparatus is so economical and efficient that it may be used for renewing even relatively short track sections.

The above and other objects, advantages and features of the present invention will become more apparent from the following detailed description of certain now preferred embodiments thereof, taken in conjunction with the accompanying schematic drawing wherein FIG. 1 is a fragmentary side elevational view of one embodiment of an apparatus for the continuous replacement of the rails of a track, showing the forward and trailing track renewal vehicle means of the apparatus adjacent the intermediate track renewal point;

FIG. 2 is an enlarged top view of the track renewal vehicle means, seen in the direction of arrows II—II of FIG. 1; and FIG. 3 is a top view of another embodiment of the apparatus according to this invention.

Referring now to the drawing and first to FIG. 1, apparatus 1 for the continuous replacement of rails 3 and 4 of a track consisting of the two rails fastened to ties 2 by rail fastening elements 5 is represented by forward track renewal vehicle means 6 and trailing track renewal vehicle means 7. Undercarriage 8 supports forward vehicle means 6 on rails 3, 4 to be removed for mobility along first track section 9 in an operating direction indicated by arrow 44. Undercarriage 10 supports trailing vehicle means 7 on replaced rails 11, 12 for mobility along second track section 13 in the operating direction. In the embodiment illustrated in FIGS. 1 and 2, the forward and trailing vehicle means are two separate cars respectively supported on undercarriages of which only one is shown. Track renewal point 14 extends between undercarriages 8 and 10 of the forward and trailing track renewal vehicle means. Rails 3 and 4 are removed from ties 2 at point 14 adjacent first track section 9, and the removed rails are lifted and spread to be guided laterally outside the ends of the ties, where they are stored. The ties remain in position while the rail fastening elements are replaced and rails 11 and 12 are laid on the ties and secured thereto by new fastening elements.

Forward track renewal vehicle means 6 comprises frame 15 overhanging undercarriage 8 and projecting into track renewal area 14. The overhanging portion of frame 15 carries tools for unfastening rails 3, 4 from ties 2 and for removing the rails, which tools comprise rail clamping tools 16 for lifting and spreading the rails, tools 17 for lifting tie plates 18 of rail fastening elements 5 and device 19 for taking up the fastening elements. Each of those tools is adjustable vertically and horizontally relative to vehicle means frame 15 by drives 20 and 21 which link tools 16, 17 and 19 to the frame. In a known manner, device 19 includes a magnetic drum 19 which picks up the ferrous rail fastening elements from the ties and ballast after they have been loosened and conveyor 22 is associated with device 19 to remove the fastening elements.

In the embodiment of FIGS. 1 and 2, apparatus 1 comprises a device for producing markings 46 on ties 2 indicate the position of first track section 9, the illustrated device comprising carrier frame 23 connected to undercarriage 8 for movement therewith and extending into the region of tools 17 for lifting tie plates 18 off ties 2. Marking mechanism 24 is mounted on the end of frame 23 remote from undercarriage 8 and adjacent tools 17.

Trailing track renewal vehicle means 7 also comprises a frame overhanging undercarriage 10 and projecting into track renewal area 14. The overhanging portion of frame 25 carries tools for laying rails 11, 12 on ties 2 and fastening the rails to the ties, which tools comprise surfacing means 49 for smoothing the two areas of each tie 2 supporting the rails, tools 37 for placing new tie plates 38 on the surfaced tie areas, crib sweepers 35 arranged forwardly of surfacing means 49 in the operating direction for sweeping the cribs adjacent the two rail supporting tie areas, and tie holding device 36 for holding the ties down in the ballast. Rearwardly of tools 37, spike drivers 41 are arranged for provisonally securing tie plates 38 to ties 2. Furthermore, the tools comprise rail clamping tools 45 for guiding and placing rails 11 and 12 on the ties plates. Tools 37 are vertically and horizontally adjustable relative to vehicle means frame 25 by drives 39 and 40 which link the tools to the frame.

According to the invention, monitoring device 27 is associated with trailing track renewal vehicle means 7 and is arranged to sense markings 46 on ties 2 as the trailing track renewal vehicle means moves along second track section 13 and to be guided by the markings which indicate the position of first track section 9. In the preferred embodiment herein illustrated and described, track gauging device 26 is connected to monitoring device 27. The track gauging device is adjustably mounted on the overhanging portion of trailing track renewal vehicle means frame 25 in a plane extending substantially parallel to the track plane for adjustment transversely to the track, the illustrated track gauging device consisting of frame 28 extending in the parallel plane. Vertical pivot 29 mounts frame 28 on trailing track renewal vehicle means 7 for pivotal adjustment of the frame transversely to the track, the pivot being arranged substantially centrally on the trailing vehicle means. As shown, pivot 29 is constituted by an upward extension of the pivot for swivel truck 10 forming the undercarriage for the trailing vehicle means. Pivoting drive 30 connects track gauging device 28 and trailing vehicle means 7 for transversely adjusting the frame, the pivoting drive being operable in response to the monitoring device. The pivoting drive is shown as hydraulic motor 31. Track gauging device frame 28 includes straight guide element 32 and 33 associated with each rail 11 and 12. The straight guide elements serve as abutments for a succession of fastening elements 5 fastening each rail to the ties in the two supporting areas of ties 2. In the illustrated embodiment, the fastening elements include tie plates 38 having lateral edges and straight guide elements 32, 33 serve as abutments for the lateral edges of the tie plates.

Since the track gauging device hereinabove described is transversely adjustable relative to the trailing track renewal vehicle means and its position is independent of that of trailing vehicle means frame 25, its straight guide elements 32, 33 are capable of accurately positioning new tie plates 38 at the original gauge and in alignment with the original track as apparatus 1 continuously moves in operating direction 44. A succession of rail fastening elements may be simultaneously centered and aligned since the straight guide elements have a length extending over several ties. This produces a straight rail support independent of the position of individual ties 2.

Track gauging device from 28 extends in the direction of track axis or center line 47 and is pivotal by drive 30 about pivot 29 which is substantially centered on the trailing vehicle means. This enables the rail fastening elements to be placed on the ties and aligned without difficulty since the track gauging device is positioned, at one end, by the pivot in the range of swivel truck 10 while the location of its other end is determined by the course of the first track section sensed by monitoring device 27.

In the illustrated embodiment, track gauging device frame 28 carries milling devices 49 for smoothing the two rail supporting areas of the ties, i.e. the monitoring device is operatively connected with the milling devices for guiding the milling devices, crib sweeping devices 35 and tie holding devices 36. The track gauging device frame with the devices carried thereby is vertically adjustably mounted on the trailing vehicle means frame by means of lifting drives 42 and 43 respectively connecting one end of frame 28 and the tie holding devices to frame 25 so that all the tools may be vertically moved between the illustrated operating position and a raised rest position during transport of apparatus 1 from one working site to another. Rail clamping tools 45 for guidance and laying the track rails on aligned tie plates 38, whose support areas have previously been smoothed by milling devices 49, are vertically and laterally adjustably mounted on frame 25 by the illustrated hydraulic motors.

FIG. 2 clearly shows the arrangements of track gauging device frame 28 associated with monitoring device 27 and of marking device 24. Vertical pivot 29 about which frame 28 is pivotal on trailing track renewal vehicle means 7 is mounted on track center line 47 so that it is centered on the vehicle means and the two straight guide elements 32 and 33 of the frame extend in the direction of the track over several ties 2 for abutment with new tie plates 38 whereby the guide elements align the tie plates at gauge, the transverse distance between guide elements 32, 33 being that of the desired track gauge. Milling devices 49 are connected to track gauging device 26 for movement therewith, the milling devices being arranged forwardly of the track gauging device in operating direction 44 and crib sweeping means 35 being arranged forwardly of the milling devices in the operating direction for sweeping the cribs adjacent the two rail supporting tie areas being milled by devices 49. The milling devices and the crib sweeping means are centered on the track gauging device by suitable mounting elements. The transverse spacing of milling devices 49 may be adjusted to the desired gauge. Monitoring device 27 is connected to track gauging device frame 28 for movement therewith and consists of pointer 50 arranged centrally between straight guide elements 32 and 33. The pointer senses markings 46 on ties 2 as trailing track renewal vehicle means 7 moves along second track section 13 and is guided by the markings.

The connection of tie milling devices 49 for movement with track gauging device 26 which, in turn, is guided by pointer 50, assures surfacing of the two areas of ties 2 supporting new tie plates 38 at the correct gauge. Sweeping the cribs ahead of the milling and milling ahead of placing the tie plates on the ties effectively produces an excellent support for the replaced rails, the laying operations proceeding in logical order without interfering with each other. Mounting monitoring device 27 centrally between straight guide elements 32, 33 of the track gauging device enables markings 46 to be produced in an area of ties 2 where no work is done, which facilitates monitoring of the markings and avoids any damage to the markings by the work.

As shown in FIG. 2, marking device 24 is mounted on carrier frame 23 which is carried on undercarriage 2 of forward track renewal vehicle means 6 and is arranged thereon substantially equidistantly from rails 3 and 4 in a direction transverse thereto. The illustrated marking device is a paint spray means, such as a nozzle, for producing colored markings and it is mounted in the range of tools 17 on forward vehicle means 6. The direct connection of marking device frame 23 to undercarriage 8 assures that markings 46 indicate the position of first track section 9 accurately.

This arrangement of markings 46 makes it possible at all times to monitor the gauge of tie plates 38 and newly laid rails 11 and 12 with respect to the original track course since reference is made directly to track center line 47. Thus, the markings may be used also for controlling the course of the track in relation to fixed reference points therealong.

Apparatus 1 described hereinabove in conjunction with FIGS. 1 and 2 may be operated in the following manner:

As the apparatus continuously advances in the direction of arrow 44, spike pullers 51 are operated to remove the spikes of fastening elements 5 to unfasten rails 3 and 4 from ties 2 and to enable rail clamping tools 16 to lift the rails off tie plates 18 and to spread the rails apart sufficiently so that they are positioned laterally outside the tie plates. Subsequently, tools 17 are operated to lift the tie plates off the ties, the ferrous rail fastening elements being removed by the magnetic drum of mechanism 19 and conveyor 22. Spray nozzle 24 is operated to produce colored markings 46 on the ties, which markings correspond to the course of the track in section 9, due to the rigid connection of marking device 24 with undercarriage 8. Any undesired markings due to a displacement of ties 2 are avoided since the marking device is arranged rearwardly of tie plate lifting tools 17 in the operating direction of the apparatus.

The two areas 52 of ties 2 supporting the tie plates must be surfaced properly before new tie plates 38 are placed thereon. This involves smoothing these areas by milling off surface layers of the wood destroyed by penetration of moisture beneath tie plates 18. At times, the heavy loads of the trains passing over the track cause tie plates 18 to be depressed into tie areas 52 and such unevenness of the tie surface must be added to assure proper supports for new tie plates 38. To make certain that the proper tie plate support areas are surfaced and the track rails are replaced at the correct gauge and following the course of first track section 9, milling tools are positioned in response to monitoring device 27 which senses and is guided by markings 46. For this purpose, pointer 40 is centered on markings 46 as apparatus 1 proceeds in direction 44. As FIG. 2 shows, this automatically produces the correct positioning of milling devices 49 which are fixed symmetically to pointer 50 on track gauging device frame 28 so that the milling devices will operate on tie areas 52 determining the course of track section 13 in alignment with track section 9. At the same time, straight guide elements 32 and 33 of track gauging device 26 serve as abutments for the lateral edges of new tie plates 38 so that tools 37 will accurately place these tie plates at gauge on surfaced tie areas 52. Thus, the tie plates are automatically laid at gauge to receive replaced rails 11 and 12. Since the straight guide elements extend over several, for instance three, ties 2, this arrangement assures a substantially straight course for the replaced rails so that replaced track section 13 will not only have the correct gauge but also the correct lateral alignment. To make certain that new tie plates 38 are not displaced from their accurate position, it is advantageous to fix them temporarily in place, for which purpose tools 41 are mounted immediately behind tools 37 for driving spikes on the like into the tie plates. Permanent fastening of fastening elements 5 in track section 13 is effected by spike drivers 53 behind swivel truck 10.

To avoid displacement of ties 2 and their markings 46 in the range of milling device 49 and crib sweepers 35, tie holding elements 36 are mounted on track gauging device frame 28 to press the ties into the ballast. By mounting crib sweepers 35 on frame 28 ahead of milling devices 49, sufficient ballast is removed from the cribs adjacent the milling devices to avoid damage to the milling cutters even where the cutters must remove a relatively thick surface layer of wood from the ties.

The position of trailing track renewal vehicle means frame 25 in replaced track section 13 is determined by the position of swivel truck 10 thereon. Since track gauging device 26 associated with monitoring device 27 is adjustable transversely to frame 25 in a plane parallel to the track plane and in relation to track center line 47, the track laying tools on frame 25 may be positioned accurately in alignment with first track section 9 and independently of the position of trailing vehicle means 7 where there are minor deviations from the desired track position. This produces a replaced track which can be used for carrying train traffic immediately after the track renewal work has been completed.

As indicated by double-headed arrow 54, tools 51 for removing rail fastening elements 5 and tools 53 for securing them to the replaced rails may be displaced in the direction of axis 47 relative to forward and trailing vehicle means 6 and 7, thes tools being mounted on rollers running in tracks on the vehicle means frames. In this manner, tools 51 and 53 may be held stationary when in use while apparatus 1 advances continuously in the direction of arrow 44.

If desired, it is also possible to mount tools for driving wooden plugs into holes in tie areas 52 between mechanism 19 and crib sweepers 35 so as to plug any holes left in these areas by the removed spikes or bolts for tie plates 18.

FIG. 3 shows another embodiment of apparatus 1, differing from the previously described embodiment by the provision of common frame 56 for forward and trailing track renewal vehicle means 55, the common frame bridging over track renewal site 14. Undercarriages 57 and 58, which are swivel trucks, respectively support a forward end of the common frame on rails 3 and 4 of first track section 9 and a trailing end of the common frame on rails 11 and 12 of second track section 13. During track renewal, apparatus 1 advances in the direction of arrow 61.

As in the first-described embodiment, a marking device is mounted rigidly on the swivel truck supporting the forward track renewal vehicle means for movement therewith to produce markings 59 indicating the position of first track section 9, rail clamping tools 68 being mounted on the forward vehicle means for lifting and spreading rails 3 and 4. While not shown in diagrammatic FIG. 3, the forward vehicle means also carries the other tools for unfastening the rails from ties 2 and for removing the rails, as more fully described in connection with FIGS. 1 and 2.

As indicated in FIG. 3, the length of common frame 56 causes the trailing end thereof to be laterally displaced with respect to track center line 63 in track curves. To enable replacement rails 11 and 12 to be laid at proper gauge and in proper alignment in track section 13 during such a lateral displacement of the trailing vehicle means and to center the rail laying tools with respect to the track center line in the manner more fully described in connection with FIGS. 1 and 2, monitoring device 65 is associated with the trailing track renewal vehicle means to sense markings 59 and to be guided by these markings. Milling devices 60 are connected to monitoring device 65 for movement therewith and track gauging device 62 is connected to the monitoring device. The track gauging device is transversely pivotal in a plane parallel to the track plane by pivotally drive 64, all in a manner functionally equivalent to that described in connection with FIGS. 1 and 2.

In this embodiment, monitoring device 65 includes an electrical sensing means for sensing markings 59 and associated with a transducer for converting the sensed marking signals into electrical control signals for operating adjustment drive 64. The transducer may be an electromechanical transducer but the illustrated transducer is a photocell means including two photocells 66 arranged on either side of markings 59 to sense a deviation from markings 59 and generate an output signal causing drive 64 to pivot track gauging device 62 until the monitoring device is again in alignment with the markings. The apparatus carries a central power plant 67 including a source of hydraulic fluid supplied to drive 64 and the other hydraulic motors on apparatus 1 for operation of the various tools. The apparatus operates in the same manner as described hereinabove in connection with the first embodiment.

The provision of a common frame for the forward and trailing track renewal vehicle means produces a compact operating unit carrying the tools required for the rail replacement, and this reduces the power requirements and simplifies the control of the operation. Furthermore, the common frame can carry the rail lifting, guiding and spreading tools, which greatly facilitates the handling of the rails at track renewal site 14 which is bridged by common frame 56. The adjustable monitoring and track gauging devices, at the same time, guide the positioning of the track rail laying tools, such as milling devices 60, independently of the position of common frame 56 so as to assure the correct position and gauge of track section 13. The distance between the marking and monitoring devices on the common frame is relatively short in the direction of track elongation so that there is little danger of the markings being disturbed by subsequent work on the ties before the markings are sensed by the monitoring device.

Obviously, track gauging device 62 may have straight guide elements for suitably locating new tie plates for rails 11 and 12, as described in connection with track gauging device 26. Also, as shown in FIG. 3, rail clamping tools 68 are mounted in track renewal region 14 to guide rails 11 and 12 at a wide gauge in this region.

Contrary to the manual operation of monitoring device 27 and track gauging device 26, whereby an operator in cab 69 observes the position of pointer 50 with respect to markings 46 and adjusts the transverse position of devices 26 and 27 to keep the pointer in alignment with the markings, the transverse positioning of monitoring and track gauging devices 65 and 62 is effected automatically in response to the control signals from photocells 66. Apparatus 1 may be self-propelled or may be pulled in the direction of arrow 44 or 61 by a locomotive.

While the markings have been described as colored marks 46 and 59, other marking means may obviously be used, such as marking nails or spikes or marking strips affixed to ties 2. Even the fastening elements 5 themselves, such as the lateral edges of the tie plates or the spikes or bolts fastening the rails to the ties, may be used as markings indicating the position of the first track section.

What is claimed is:

1. An apparatus for the continuous replacement of the rails of a track consisting of two rails fastened to ties, which comprises (a) a forward track renewal vehicle means for removing the rails adjacent a first track section, the forward vehicle means including (1) an undercarriage supporting the forward vehicle means on the rails to be removed for mobility along the track section in an operating direction, and (2) tools for unfastening the rails from the ties and for removing the rails, (b) a trailing track renewal vehicle means for replacing the rails adjacent a second track section, the trailing vehicle means including (1) an undercarriage supporting the trailing vehicle means on the replaced rails for mobility along the second track section in the operating direction, and (2) tools for laying the rails on the ties, and (c) a monitoring device associated with the trailing track renewal vehicle means, the monitoring device being arranged to sense markings on the ties as the trailing vehicle means moves along the second track section and to be guided by the markings, the markings indicating the position of the first track section and the monitoring device being arranged to position the rails of the second track section in alignment with the first track section.

2. The apparatus of claim 1, wherein fastening elements fasten the rails to the ties in two areas of each tie supporting the rails, the tools on the forward vehicle means comprising means for removing the fastening elements and for raising and spreading the rails, and the tools on the trailing vehicle means comprising means for surfacing the two rail supporting areas of each tie, for laying the rails and for securing the fastening elements to fasten the laid rails to the ties at the surfaced rail supporting areas.

3. The apparatus of claim 2, further comprising a track gauging device connected to the monitoring device, the track gauging device being adjustably mounted on the trailing vehicle means in a plane extending substantially parallel to the track plane for adjustment transversely to the track and the track gauging device including a straight guide element associated with each rail and serving as an abutment for a succession of the fastening elements fastening each rail to the ties in the two supporting areas.

4. The apparatus of claim 3, wherein the track gauging device is pivotally adjustably mounted in said parallel plane.

5. The apparatus of claim 3 or 4, wherein the fastening elements include tie plates having lateral edges and the straight guide elements serving as abutments for the lateral edges of the tie plates.

6. The apparatus of claim 2, wherein the surfacing means comprises milling devices for smoothing the two supporting areas of the ties, and the monitoring device is operatively connected with the milling devices for guiding the milling devices.

7. The apparatus of claim 6, further comprising a track gauging device connected to the monitoring device, the track gauging device being adjustably mounted on the trailing vehicle means in a plane extending substantially parallel to the track plane for adjustment transversely to the track, and the milling devices being connected to the track gauging device for movement therewith.

8. The apparatus of claim 7, wherein the milling devices are arranged forwardly of the track gauging device in the operating direction, and further comprising crib sweeping means arranged forwardly of the milling devices in the operating direction for sweeping the cribs adjacent the two rail supporting tie areas.

9. The apparatus of claim 1 or 2, further comprising a track gauging device connected to the monitoring device, the track gauging device including a frame extending in a plane substantially parallel to the track plane, a vertical pivot mounting the frame on the trailing vehicle means for pivotal adjustment of the frame transversely to the track, the pivot being arranged substantially centrally on the trailing vehicle means, and a pivoting drive connecting the track gauging device frame and the trailing vehicle means for transversely adjusting the frame, the pivoting drive being operable in response to the monitoring device.

10. The apparatus of claim 9, wherein the frame includes a straight guide element associated with each rail and serving as an abutment for a succession of the fastening elements fastening each rail to the ties in the two supporting areas, and the monitoring device is mounted substantially equidistantly between the straight guide elements in a direction extending transversely to the rails.

11. The apparatus of claim 10, wherein the monitoring device includes a pointer.

12. The apparatus of claim 11, wherein the monitoring device includes an electrical sensing means associated with a transducer.

13. The apparatus of claim 12, wherein the transducer is a photocell means.

14. The apparatus of claim 1 or 2, further comprising a device for producing the markings on the ties.

15. The apparatus of claim 14, wherein the device for producing the markings includes a paint spray means for producing colored markings and the paint spray means is arranged on the forward vehicle means substantially equidistantly from the rails in a direction transverse thereto.

16. The apparatus of claim 15, wherein the paint spray means is mounted in the range of the tools on the forward vehicle means.

17. The apparatus of claim 14, further comprising a common frame for the forward and trailing track renewal vehicle means, the undercarriages respectively supporting a forward and a trailing end of the common frame.

* * * * *